US009984781B2

(12) United States Patent
Prelas

(10) Patent No.: US 9,984,781 B2
(45) Date of Patent: May 29, 2018

(54) SOLID-STATE NUCLEAR ENERGY CONVERSION SYSTEM

(71) Applicant: The Curators of the University of Missouri, Columbia, MO (US)

(72) Inventor: Mark A. Prelas, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 203 days.

(21) Appl. No.: 15/224,009

(22) Filed: Jul. 29, 2016

(65) Prior Publication Data

US 2017/0309358 A1 Oct. 26, 2017

Related U.S. Application Data

(60) Provisional application No. 62/199,104, filed on Jul. 30, 2015.

(51) Int. Cl.
*G21H 1/04* (2006.01)

(52) U.S. Cl.
CPC ..... *G21H 1/04* (2013.01)

(58) Field of Classification Search
CPC ..... G21H 1/00–1/12
USPC ..... 310/301–305
See application file for complete search history.

(56) References Cited

U.S. PATENT DOCUMENTS 6,118,204 A * 9/2000 Brown ..... G21H 1/06 136/202
6,329,587 B1 * 12/2001 Shoga ..... G21H 1/10 136/202
2011/0298332 A1 * 12/2011 Miller ..... B64G 1/44 310/303

OTHER PUBLICATIONS

McKay, K.G.; "The Crystal Conduction Counter;" Physics Today; May 1953.

* cited by examiner

*Primary Examiner* — Thomas Truong
(74) *Attorney, Agent, or Firm* — Erise IP, P.A.

(57) ABSTRACT

A solid-state nuclear energy conversion system includes a crystalline insulator bombarded with radiation to create electron-hole pairs. A voltage source provides a potential bias across the crystalline insulator, causing electrons and holes to collect at opposing ends. A diode is incorporated in a circuit including the crystalline insulator, voltage source, and a load, inhibiting current flow from the voltage source to the load. Thus, a radiation-driven current flows to the load.

20 Claims, 3 Drawing Sheets

SOLID-STATE NUCLEAR ENERGY CONVERSION SYSTEM

RELATED APPLICATIONS

This non-provisional patent application claims priority benefit, with regard to all common subject matter, of earlier-filed U.S. Provisional Patent Application No. 62/199,104, filed on Jul. 30, 2015, and entitled "SOLID-STATE NUCLEAR ENERGY CONVERSION SYSTEM" (the '104 Application). The '104 Application is hereby incorporated by reference in its entirety into the present application.

FIELD

Embodiments of the invention are broadly directed to electrical current generation systems based on radiation-driven electron-hole pair creation in a crystalline insulator.

RELATED ART

Major obstacles limiting human technologies, particularly space exploration, are the available systems and methods of generating and/or carrying long-lasting, dependable power. Conventional chemical batteries are insufficient for many high-power or extended-use applications.

Conversion of nuclear energy to electric energy has been accomplished by exploiting the decay heat of a radioactive source material, an inefficient method requiring a system that is both prohibitively large and weak for many applications. The most efficient means of converting radiation to electrical current is to directly collect the charge created by ionization within an insulator. Such a system that could directly utilize energy carried by ionizing radiation for the production of electricity would be smaller, lighter, and more efficient.

SUMMARY

Embodiments of the invention provide systems and methods for providing power to a load via a current driven by absorption of radioactive particles in one or more crystalline insulators. A first embodiment of the invention is directed to a system for powering a load comprising a radiation source, at least one crystalline insulator, two or more electrodes, a voltage source, and a diode. Radiation from the radiation source bombards a crystalline insulator to create electron-hole pairs. The voltage source biases the crystalline insulator such that the holes and electrons collect at opposing ends. Electrodes attached at these ends allow a current to flow to an attached load. The diode inhibits current from flowing to the attached load from the voltage source.

A second embodiment of the invention is directed to a method of utilizing radiation to power a load by bombarding one or more crystalline insulators with radiation from radiation sources, freeing electrons from the crystalline lattice structure. Providing a biasing voltage causes the freed electrons collect at one end of the crystalline insulator(s), leaving a net positive charge (or "holes") to collect at the opposite end. Electrodes attached at each end allow current created by this charge separation to power a load. Inhibition of current flow from the voltage source to directly power the load is performed using a diode.

This summary is provided to introduce a selection of concepts in a simplified form that are further described below in the detailed description. This summary is not intended to identify key features or essential features of the claimed subject matter, nor is it intended to be used to limit the scope of the claimed subject matter. Each of the above embodiments may include further insulators, electrodes, diodes, wires, switches, semiconductors, resistors, capacitors, inductors, and/or voltage sources. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
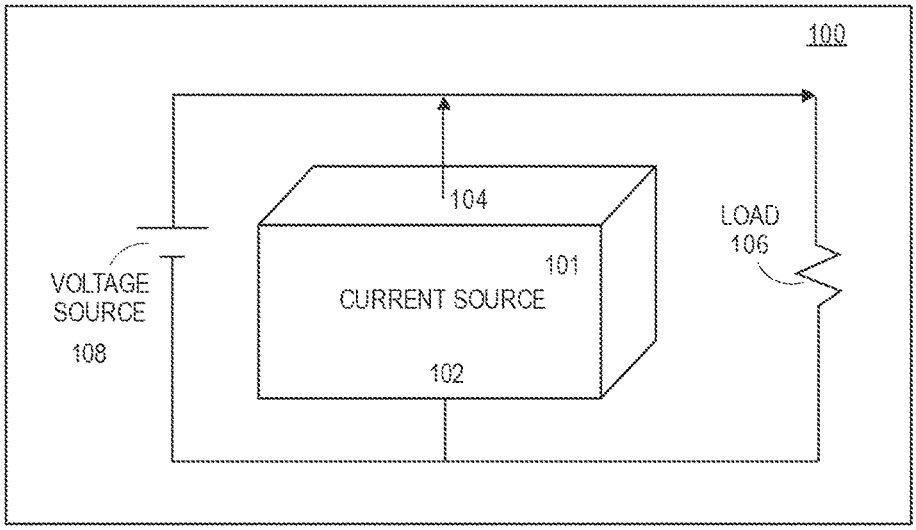
FIG. 1 is a first schematic view of various components of a solid-state nuclear energy conversion system including a current source, a voltage source, and a load.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 2:
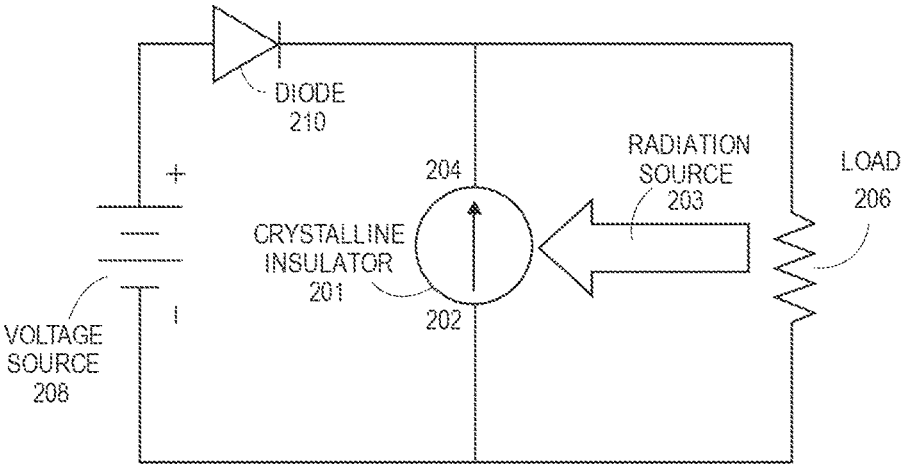
FIG. 2 is a second schematic view of various components of a solid-state nuclear energy conversion system including a radiation source, crystalline insulator, voltage source, diode, and a load resistor.

FIG. 1 shows a general diagram of embodiments of the invention including current source 101 attached at opposing ends by electrodes 102 and 104 to voltage source 108 and load 106. FIG. 2 shows a detailed embodiment of the general system 100 of FIG. 1, including a crystalline insulator 201 being bombarded by ionizing radiation from radiation source 203 attached at opposing ends by electrodes 202 and 204 to voltage source 208, diode 210, and load 206. It should be appreciated that, like other Figures herein, FIG. 1 and FIG. 2 illustrate exemplary embodiments of the invention for the purpose of explaining concepts to the reader.

Embodiments of the invention solve the above problems of conventional nuclear batteries by bombarding a crystalline insulator 201 with radiation from radiation source 203, causing electron-hole pair creation. A potential difference across crystalline insulator 201 provided by a voltage source 208 exerts opposite forces on the electrons and holes, causing them to separate and collect at opposing ends, as discussed below. The current rising from this charge separation flows to an attached load 206, and a diode 210 is incorporated to prevent the load 206 from drawing current directly from the voltage source 208.

In a hypothetical perfect crystal, every electron is secured in place by covalent bonds between neighboring atoms. This creates what is known as a crystal lattice, with patterns of atoms forming repeating patterns in three-dimensional space, linked together by the bound electrons. With no electrons free to move and carry charge, a current applied to a perfect crystal is completely unable to pass. For this reason, a perfect crystal is an electrical insulator. A perfect crystal is also charge-neutral, meaning it contains as many protons as electrons. Any electron added would give the crystal a net negative charge; any proton added would give the crystal a net positive charge.

If, rather than adding or removing an electron, an electron that was previously present in a perfect crystal is liberated from its location within the crystalline lattice structure, the newly freed electron would carry away a small amount of negative charge, leaving behind an equivalent net positive charge. Energy must be introduced to free such an electron from its bounds, be it in the form of heat, light, etc. Particularly, in embodiments of the invention, absorption of radiation due to the decay of radioactive elements can cause electrons in a crystalline lattice to be freed from their position in the rigid formation.

When a crystal's perfect electronic structure is broken, a negatively charged electron moves about and the positively charged atom left behind is known as a "hole." Since the atom remains locked in the crystalline lattice, it is unable to move. However, if an electron from a neighboring atom replaces the electron that was freed, the positively charged "hole" effectively moves, even though the atom cannot. In this way, freeing electrons in a crystalline lattice that can give rise to local concentrations of positive and negative charge, and this charge can be moved and or collected throughout an insulator.

Under normal circumstances, freed electrons will eventually "recombine" with the holes, emitting a photon of light (to conserve energy) and settling the ideal crystal back into its original perfect electronic structure. However, if a potential difference is applied across the crystal (known as "biasing" the crystal), the electrons will begin to collect at a first end of the crystal, while being pushed away from the second, opposing end. Again, though the crystal's atoms cannot actually move, the positively charged "holes" effectively move towards this opposing end, collecting in a similar manner to the electrons. Electron-hole pair creation and separation has been discussed in a scholarly article by K. G. McMay, entitled "The Crystal Conduction Counter," published in Physics Today in May, 1953. The above-mentioned article is hereby incorporated by reference in its entirety.

Embodiments of the invention incorporate structures described above. FIG. 1 illustrates a generalized circuit 100 of embodiments, including a voltage source 108, load 106, and current source 101 connected by electrodes 102 and 104. Electrodes 102 and 104 may be embedded in each ends of current source 101. In this configuration, voltage source 108 provides a potential difference to both load 106 and current source 101. Negative charge flows from the first end 102 of current source 101 through electrode(s) 102 and attached wires, across the load 106, and back into the crystalline current source at the second end 104. As a matter of notation, current is traditionally defined as the effective direction of flow of positive charge. Consequently, the direction of current in circuit 100 is actually up from current source 101 at end 104, around and down through load 106, and back up into current source 101 at end 102, though the actual movement of electrons is the reverse.

Embodiments of the invention provide current source 101 through the interaction of a radiation source and a crystalline insulator. A charge separation driven by absorption of the radiation by the crystalline insulator supplies current to an attached load 106. As further discussed below, voltage source 108 is necessary to extract current from the insulator, but may be quickly consumed by load 106 unless inhibited. In practice, the load 106 may be an electronic system of an extraterrestrial vehicle such as a space probe, which needs a very long-lasting, compact, efficient, and dependable power supply.

An example such a system configured to convert radiation from a source directly to an electric current is illustrated in FIG. 2, including crystalline insulator 201, radiation source 203, voltage source 208, and load 206. In embodiments, radiation from radioactive source 203 bombards crystalline insulator 201, which is biased by voltage from a voltage source 208 to collect electrons at a first end and holes at a second end. Electrodes 202 and 204 attached at these opposing ends enable the crystal to become part of a circuit that includes the voltage source 208 and a load 206. In embodiments of the invention, electrodes 202 and 204 may be embedded in each end of the crystalline insulator 201. The embodiment of the invention illustrated in FIG. 2 further includes a diode 210, as described below. Embodiments of the invention may incorporate any or all of the features and structures illustrated, and may include additional features or structures not illustrated in FIG. 2.

In embodiments of the invention, radiation source 203 may emit alpha particle radiation. Isotopes of uranium, thorium, and/or gadolinium may be used as a source of alpha particle radiation in embodiments of the invention, but these examples are not intended to be limiting. Any source or sources of alpha particle radiation may be used in embodiments of the invention.

In alternative embodiments of the invention, radiation source 203 may emit beta particle radiation. Isotopes of hydrogen, nickel, strontium, palladium, and/or yttrium may be used as a source of beta particle radiation in embodiments of the invention, but these examples are not intended to be limiting. Any source or sources of beta particle radiation may be used in embodiments of the invention.

Embodiments of the invention may incorporate a chemical battery to serve as voltage source 208. Alternatively, voltage source 208 may be any other source of voltage, such as a capacitor or another nuclear battery. Voltage source 208 may include several batteries of any type connected in a bank for increased longevity or dependability. In embodiments of the invention, the voltage supplied by voltage source 208 may be drawn from an external environment, such as by connection to a solar panel or external charge source. These are merely examples of the types of structures that may serve as voltage source 208, and are not intended to be limiting. Any combination of the above is intended to be included, as well as any other voltage source.

A problem that arises in practical applications of embodiments of the invention is the natural tendency for the load 206 to draw current (at least partially) directly from voltage source 208, short-circuiting the crystalline insulator 201. As illustrated in FIG. 2, embodiments of the invention address this problem by incorporating a diode 210 between the voltage source 208 and the load 206. In embodiments of the invention, diode 210 is not located between crystalline insulator 201 and load 206.

In general, a diode is an electronic component with asymmetric resistance, allowing electric current to flow freely in one direction and inhibiting current flow in the opposite direction. Diode 210 acts as a one-way valve in embodiments of the invention, inhibiting current flow from the voltage source 208 to the load 206, without interfering in the flow of current from crystalline insulator 201. Even with diode 210 included, voltage source 208 is able to bias crystalline insulator 201 such that the potential difference between first end 202 and second end 204 is equal to the voltage supplied by voltage source 208. In embodiments of the invention, a voltage source 208 is connected in parallel in a circuit with a crystalline insulator 201 and load 206. Additionally or alternatively, in embodiments of the invention, a diode 210 is connected in series in a circuit with a voltage source 208 and load 206.

Modern diodes may be wholly or partially comprised of semiconductors doped to have an excess of holes ("p-type semiconductors") and/or doped to have an excess of electrons ("n-type semiconductors"). A combination of these two types of semiconductors, commonly known as a p-n junction, allows current to flow only from the p-type side to the n-type side, providing the one-way valve in embodiments of the invention. Embodiments of the invention include a diode 210 comprising a p-type semiconductor in contact with an n-type semiconductor.

Alternatively, in what is known as a Schottky diode, the p-type side of the junction may be replaced by a metal such as platinum. A Schottky diode may be used as diode 210 in embodiments of the invention. Particularly, a variable impedance Schottky diode may be employed as diode 210 in embodiments of the invention, as further discussed below.

As previously discussed, voltage source 208 maintains a biasing voltage across crystalline insulator 201, illustrated in FIG. 2. By Ohm's law, there is also a voltage change across load 206 equal to the product of the impedance of the load 206 and the current flowing through it. By Kirchoff's voltage law, the sum of the potential differences around every closed loop in the system must be zero. Therefore, in order for current to flow from the crystalline insulator source 201 across the load 206, the impedance of the load 206 must be equal to the impedance of diode 210.

In embodiments of the invention, diode 210 is configured such that it has the same impedance as load 206. In further embodiments of the invention, diode 210 has variable impedance, and is configured to adjust to an equal impedance to load 206. In embodiments of the invention, the impedance of diode 210 may be adjusted manually or automatically in response to changes in the impedance of load 206. For instance, an external controller (not shown) may sense that the impedance of load 206 has increased, and subsequently increase the impedance of diode 210 to match. Alternatively, the external controller may cause the impedance of load 206 to drop (for instance, by shutting down a subsystem powered by embodiments of the invention), and simultaneously adjust the impedance of diode 210 to match.

Crystalline insulators 201 used in embodiments of the invention may be, for instance, composed of materials such as diamond or gallium nitride. These materials are intended only as examples, and are not meant to be limiting. Crystalline insulator 201 was considered above in relation to the characteristics of a perfect crystal, without symmetry-interrupting defects or impurities. In practice, a real crystalline insulator 201 will have both of these types of imperfections, which act as "traps" to charge-carrying electrons and holes, reducing the efficiency of the nuclear energy conversion system. This is because charge carriers entering the vicinity of traps exchange energy with the nearby atoms to achieve an overall lower-energy configuration, but as a result lack sufficient energy to continue to drift. Traps created during production of the crystalline insulator may be minimized in embodiments of the invention by practices such as single crystal growth, but defects due to radiation exposure are unavoidable. In embodiments of the invention, crystalline insulator 201 is a single growth crystal, such as diamond, minimizing traps as well as negating boundary effects of multiple crystal approaches.

Another obstacle to creating a solid-state nuclear energy conversion system is the destructive nature of radioactive particles. As insulator 201 in embodiments of the invention is bombarded with radiation, its nearly-perfect crystalline structure will be continuously damaged, giving rise to an increasing number of traps, raising the insulator's resistance, and reducing the efficiency of the system over time. If left unchecked, this radiation damage would eventually cause such an increase in resistance in the crystalline insulator that electrons and holes would be incapable of attaining the charge separation necessary to drive a current across load 206.

Embodiments of the invention address the issue of cumulative lattice damage and subsequent trap formation by employing periodic and/or continuous annealing of the crystal. Annealing is a physical process by which sufficient energy is added to the lattice structure of a crystal so that its constituent atoms are able to return to a more appropriate configuration. For instance, if the temperature of a diamond crystal rises to around 600-800K, atoms within the diamond that have been displaced from their ideal lattice position will be perturbed, allowing them to shift. Naturally, the atoms will tend to shift towards the lowest energy configuration, that of the ideal crystal lattice. This is intended merely as example; embodiments of the invention may operate at any temperature necessary for periodic or continuous annealing of the particular material of crystalline insulator 201.

In embodiments of the invention, the current source portion 101 of the device constantly or periodically operates at a temperature where annealing can occur. Radioactive decay within radiation source 203 may supply the required heat to reach this temperature. Alternatively or additionally, in embodiments of the invention, the crystal insulator 201 may be constantly or periodically annealed through energy added to the crystal from sources other than radiation source 203, for example from a laser.

Maximizing the power output of current source 101 requires that the impedance of the load remain high (~0.1 MΩ to 1 MΩ). If the impedance of the load 206 drops too low, the power output of the system decreases substantially, wasting a large portion of the energy available from radiation source 203. In embodiments of the invention, the current generated in insulator 201 by the interaction of ionizing radiation from source 203 is harvested by a fixedimpedance load resistor and collected for use in variable load applications. This static configuration ensures that the impedance of the load 206 will remain sufficiently high to maintain efficient utilization of radiation source 203.

In embodiments of the invention, a protective layer partially or wholly surrounds crystalline insulator 201 and/or radiation source 203, insulating them from other portions of the invention and/or their surroundings. In some embodiments the protective layer provides thermal insulation, such that the radiation source 203 and crystalline insulator 201 may operate at a temperature high enough to allow annealing of the crystalline insulator without damaging other portions of the invention and/or their surroundings. Additionally or alternatively, in some embodiments the protective layer provides mechanical insulation, protecting the delicate lattice structure of the crystalline lattice from damage. Additionally or alternatively, in some embodiments the protective layer provides radiation shielding, protecting other portions of the invention and/or surroundings from being irradiated. In embodiments of the invention, a protective layer providing any or all of thermal insulation, mechanical insulation, and/or radiation shielding may surround any or all layers 302,304,306 of FIG. 3 and/or 402,404,406, and 420,422,424,426 of FIG. 4.

Another consideration, in embodiments of the invention, is the penetration depth in crystalline insulator 201 of particles emitted by radiation source 203. The deeper a particle of radiation penetrates into an insulator, the more likely it is to be absorbed at some point during its penetration. The depth at which the intensity of radiation falls to 1/e of its original value (approximately 37%) is called the penetration depth of the radiation. This depth will vary for particular crystalline insulators, but for diamond is on the order of 10-20 microns.

Figure 3:
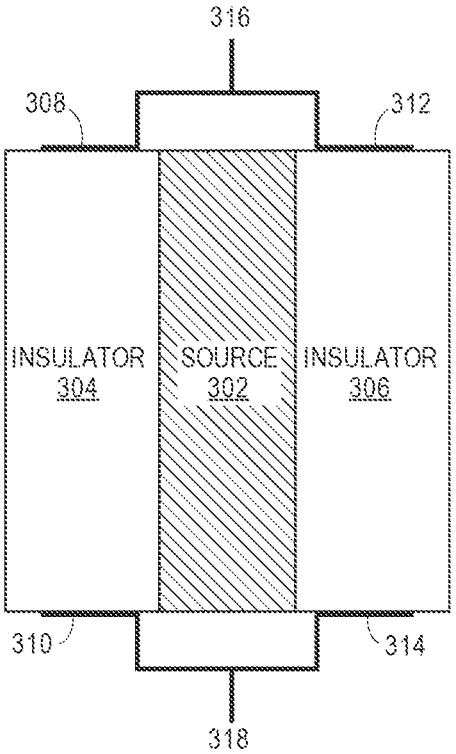
FIG. 3 is an illustration of a first configuration of a radiation source and insulators.

In embodiments of the invention, the crystalline insulator 201 provided in layers with a thickness equal to, proportional to, or otherwise associated with the penetration depth of the radiation from the radiation source. FIG. 3 shows a first possible configuration of crystalline insulator 201 and radiation source 203, wherein radiation source 302 is sandwiched between layers 304 and 306 of crystalline insulator 201 attached by electrodes 308,310,312,314 to provide current source 101 in circuit 100 of FIG. 1 (or equivalent structures of FIG. 2). As seen in FIG. 3, in embodiments of the invention, the crystalline insulator may be disposed in multiple layers 304 and 306. Additionally, in embodiments of the invention, the radiation source 302 may be sandwiched between multiple crystalline insulator layers 304 and 306. With this "stack" formation, crystalline insulator layers 304 and 306 absorb radiation emitted from both directions of the radiation source 302 to maximize electron-hole pair creation. Holes collect near attached electrodes 308 and 312, while electrons collect at attached electrodes 310 and 314. FIG. 3 is drawn in the given proportions for the sake of illustration, and may not be to scale. In embodiments of the invention, layers 302, 304, and 306 may have a much greater length (e.g., vertically as illustrated in FIG. 3) than thickness (e.g., horizontally as illustrated in FIG. 3), for example the length may be at least 100 times the thickness, at least 1,000 times the thickness, or at least 10,000 times the thickness.

Figure 4:
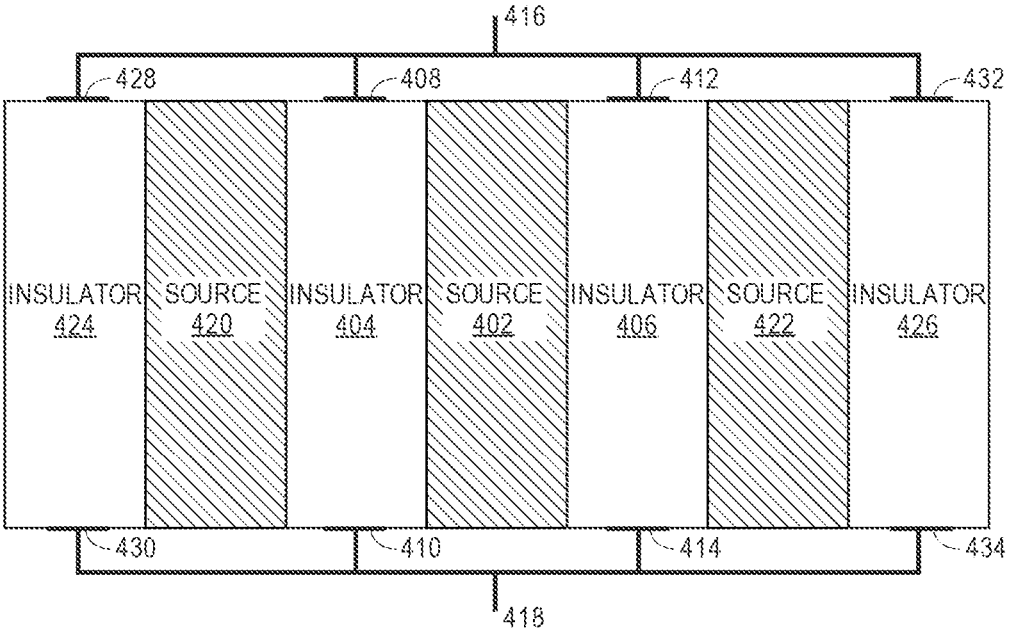
FIG. 4 is a second configuration of radiation sources and insulators.

The formation illustrated in FIG. 3 is an example of a "stack" formation, defined as alternating layers of radiation source 203 and crystalline insulator 201. FIG. 4 shows a second possible configuration of crystalline insulator 201 and radiation source 203, wherein radiation source 402, radiation source 420, and radiation source 422 are sandwiched between respective layers 404,406,424,426 of crystalline insulator 201 attached by electrodes 408,410,412,414 and 428,430,432,434 to provide current source 101 in circuit 100 of FIG. 1 (or equivalent structures of FIG. 2). FIG. 4 illustrates another embodiment of a stack formation, extending the pattern of FIG. 3 to include three radiation source layers 402,420,422, and four crystalline insulator layers 404,406,424,426. Each of the crystalline insulator layers are attached by electrodes 408,412,428,432 to wire 416 on one end and by electrodes 410,414,430,434 to wire 418 on the other end. Wire 416 and wire 418 connect the stack formation of radiation source and crystalline insulator layers into a circuit 100 (as seen in FIG. 1) so that current can flow to load 106.

While reference has been made above to the various components and techniques of embodiments of the invention, the description that follows will provide examples of the systems and processes of embodiments of the invention, further clarifying each feature and step. The examples below are intended to merely exemplify steps that may be taken in practice of operation of embodiments of the invention and are not intended to be limiting.

Figure 5:
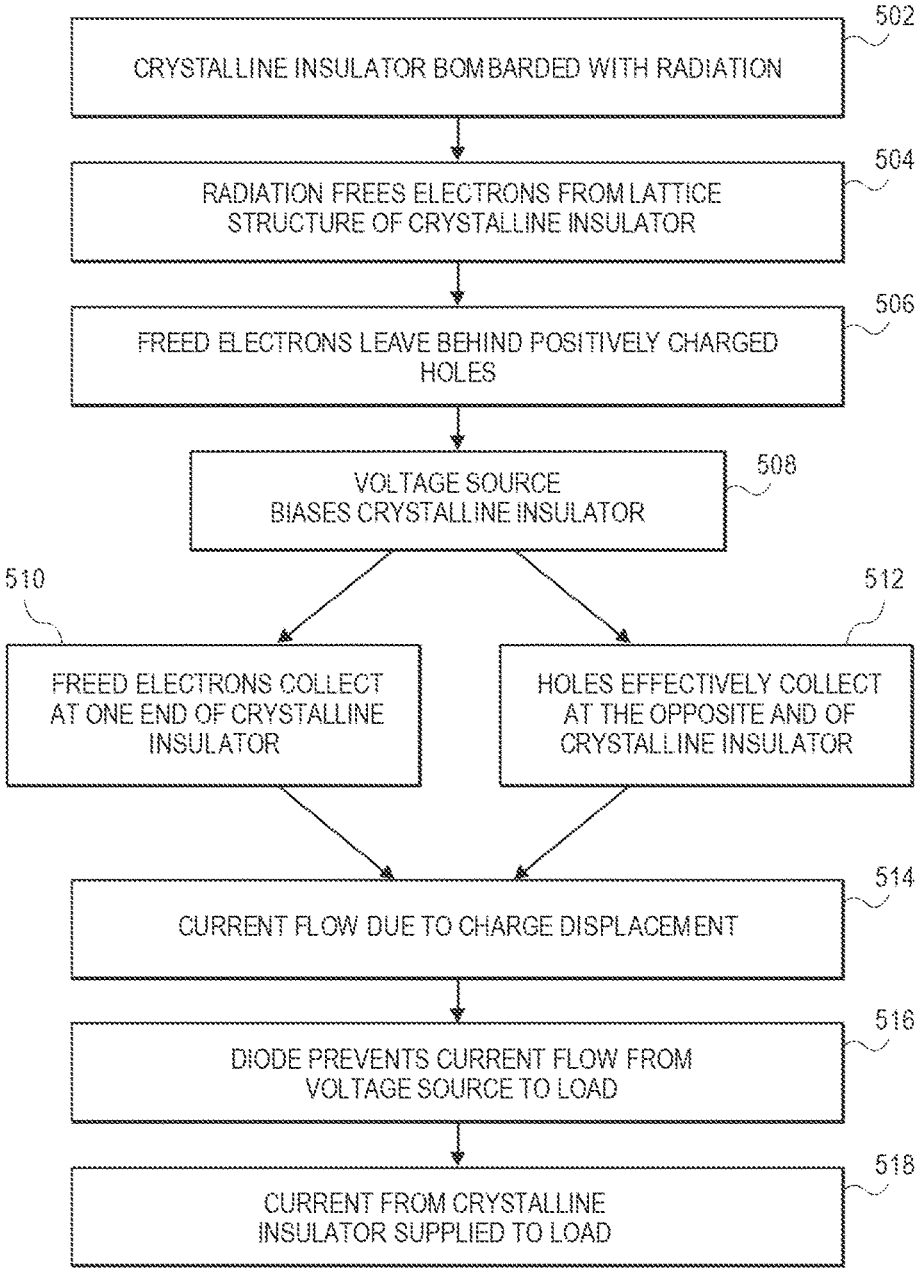
FIG. 5 is a flow diagram of steps performed in embodiments of the invention.

FIG. 5 illustrates steps performed in operation of an embodiment of the invention, beginning at step 502 with radiation bombardment of a crystalline insulator. The steps performed illustrate the process of creating electron-hole pairs and utilizing a voltage source to generate current to power a load.

First, at step 502, radio active particles bombard a crystalline insulator 201. The source of the radiation 203 may be, for example, an unstable isotope of an element experiencing radioactive decay. The crystalline insulator 201 may be constructed in a stack formation, with layers of the radiation source (e.g. 302) sandwiched between layers of crystalline insulator (e.g. 304,306) approximately equal to the penetration depth of the radiation. Radioactive particles from the source enter a layer of the crystalline insulator, and are absorbed at step 504. The energy of these absorbed particles frees a plurality of electrons from their bound positions within the crystalline lattice structure. Freeing the electrons results in corresponding net positive charges left behind, known as holes.

At step 506, a voltage source 208 maintains a potential difference across the layer of crystalline insulator 201, exerting opposite forces on the freed electrons and holes. Because of these forces, at step 510 the freed electrons collect at one end of the crystalline insulator, and at step 512 the migration of net charges causes the holes to effectively collect at the opposite end. Each of these ends is attached to an electrode (e.g. 308,310,312,314), allowing current to flow in an attached circuit due to charge displacement in step 514.

At step 516, a diode 210 positioned between the voltage source 208 and load 206 prevents the current from flowing from the voltage source to the load. Diode 210 has an impedance equal to the impedance of load 206, and in some embodiments, diode 210 is a variable impedance diode, which adjusts to match the impedance of the load 206 at all times. At step 518, the current flow from crystalline insulator 201 driven but radiation source 203 is supplied to load 206.

It should be appreciated that, while the above disclosure is directed mainly to the field of powering components of extraterrestrial vehicles, embodiments of the invention may be used to provide power for any application. Embodiments of the invention may be used in any setting or field, such as military hardware or medical appliances. The field discussed of powering vehicles for space exploration is merely exemplary and should not be construed as limiting.

Having thus described various embodiments of the invention, what is claimed as new and desired to be protected by Letters Patent includes the following:

1. A nuclear energy conversion system for providing current to a load comprising:

a crystalline insulator;

a radiation source;

wherein radiation from the radiation source bombards said crystalline insulator to free a plurality of electrons from a lattice structure of said crystalline insulator;

wherein freeing said plurality of electrons from said lattice structure generates a plurality of holes;

a first electrode attached to a first end of said crystalline insulator and a second electrode attached to a second end of said crystalline insulator;

a voltage source connected in parallel to said crystalline insulator and the load;

wherein the voltage source biases said crystalline insulator such that said freed electrons collect at the first end and said holes collect at the second end causing a first current flow;

wherein said first current flow is supplied to the load; and a diode connected in series with said voltage source and said load to inhibit a second current flow from the voltage source to the load.

2. The system of claim 1, wherein said crystalline insulator is comprised of diamond.

3. The system of claim 1, additionally comprising a protective layer providing radiation shielding of at least one of said crystalline insulator and said radiation source.

4. The system of claim 1, additionally comprising a protective layer providing thermal insulation to at least one of said crystalline insulator and said radiation source.

5. The system of claim 1, additionally comprising a protective layer providing mechanical insulation to at least one of said crystalline insulator and said radiation source.

6. The system of claim 1, wherein said first electrode is embedded in the first end of said crystalline insulator and said second electrode is embedded in the second end of said crystalline insulator.

7. The system of claim 1, wherein said crystalline insulator is self-annealed by heat produced by radiation bombardment from the radiation source.

8. The system of claim 1, wherein said voltage source is at least one chemical battery.

9. The system of claim 1, wherein the crystalline insulator is a first crystalline insulator, wherein the system further comprises a second crystalline insulator, wherein the radiation source is located between the first crystalline insulator and the second crystalline insulator.

10. The system of claim 1, wherein one of said first crystalline insulator and said second crystalline insulator has a thickness equal to a penetration depth of radiation from said radiation source.

11. The system of claim 1, wherein said diode comprises a p-type semiconductor in contact with an n-type semiconductor.

12. A method of utilizing radiation to supply power to a load, the method including the following steps:

bombarding one or more crystalline insulators with radiation from one or more radiation sources;

wherein said radiation frees a plurality of electrons from a lattice structure of said one or more crystalline insulators;

wherein freeing the plurality of electrons from said lattice structure generates a plurality of holes;

wherein a first electrode is attached to a first end of at least one of said crystalline insulators and a second electrode is attached to a second end of at least one of said crystalline insulators;

providing a voltage to bias said one or more crystalline insulators such that the freed electrons collect at said first end and the holes collect at said second end causing a first current flow;

supplying said first current flow to a load; and inhibiting a second current flow from the voltage source to the load using a diode.

13. The method of claim 12, wherein the diode is a variable impedance diode, wherein an impedance of the diode is configured to equal an impedance of the load.

14. The method of claim 13, wherein said diode comprises a p-type semiconductor in contact with an n-type semiconductor.

15. The method of claim 12, wherein said crystalline insulator is periodically self-annealed by heat produced through bombardment.

16. The method of claim 12, wherein said one or more radiation sources and said one or more crystalline insulators are constructed in a stack formation.

17. The method of claim 12, wherein said radiation bombarding said crystalline insulator is alpha particle radiation.

18. The method of claim 17, wherein said alpha particle radiation is generated by decay of a radioactive isotope of an element selected from a group consisting of uranium, thorium, and gadolinium.

19. The method of claim 12, wherein said radiation bombarding said insulator is beta particle radiation.

20. The method of claim 19, wherein said beta particle radiation is generated by decay of a radioactive isotope of an element selected from a group consisting of hydrogen, nickel, strontium, palladium, and yttrium.

* * * * *